US006769579B2

(12) United States Patent
Milian

(10) Patent No.: US 6,769,579 B2
(45) Date of Patent: Aug. 3, 2004

(54) FLUID DISPENSER

(75) Inventor: Alex Milian, Breteuil Sur Iton (FR)

(73) Assignee: Valois SAS, Le Neubourg (FR)

( * ) Notice: Subject to any disclaimer, the term of this patent is extended or adjusted under 35 U.S.C. 154(b) by 0 days.

(21) Appl. No.: 10/678,306

(22) Filed: Oct. 6, 2003

(65) Prior Publication Data

US 2004/0065700 A1 Apr. 8, 2004

Related U.S. Application Data

(60) Provisional application No. 60/432,668, filed on Dec. 12, 2002.

(30) Foreign Application Priority Data

Oct. 7, 2002 (FR) ..... 02 12417

(51) Int. Cl.[7] ..... B05B 11/06

(52) U.S. Cl. ..... 222/632; 222/212; 222/215; 239/326; 239/327

(58) Field of Search ..... 222/632, 633, 222/206, 212, 215; 239/327, 326

(56) References Cited

U.S. PATENT DOCUMENTS

| | | | | | |
|---|---|---|---|---|---|
| 160,698 | A | * | 3/1875 | Olson | 239/327 |
| 467,647 | A | * | 1/1892 | Somers | 222/215 |
| 553,765 | A | * | 1/1896 | Ruppolt | 222/212 |
| 630,277 | A | * | 8/1899 | Weitling | 222/212 |
| 653,866 | A | * | 7/1900 | Heiman | 222/633 |
| 1,104,607 | A | * | 7/1914 | Berger | 239/327 |
| 1,167,487 | A | * | 1/1916 | Fairwealher | 222/206 |
| 1,388,293 | A | | 8/1921 | Novotney | |
| 1,459,784 | A | * | 6/1923 | Loufek | 222/215 |
| 1,521,496 | A | | 12/1924 | Wolleson | |
| 2,048,698 | A | * | 7/1936 | Howell | 222/212 |
| 2,432,288 | A | | 12/1947 | Danziger | |
| 6,536,635 | B1 | * | 3/2003 | Garcia et al. | 222/633 |
| 2003/0094466 | A1 | * | 5/2003 | Duquet et al. | 222/212 |
| 2003/0218024 | A1 | * | 11/2003 | Garcia et al. | 222/632 |
| 2003/0230599 | A1 | * | 12/2003 | Duquet et al. | 222/212 |

FOREIGN PATENT DOCUMENTS

| | | |
|---|---|---|
| CH | 262440 A | 6/1949 |
| FR | 2 818 258 A | 6/2002 |
| GB | 599896 A | 3/1948 |

* cited by examiner

*Primary Examiner*—Kenneth Bomberg
(74) *Attorney, Agent, or Firm*—Sughrue Mion, PLLC

(57) ABSTRACT

A fluid dispenser for dispensing fluid in liquid or powder form, the fluid dispenser comprising a reservoir (17) provided with at least one deformable actuating wall (2) and with a dispensing orifice (14), said fluid dispenser being characterized in that it further comprises a body (1) defining a frame (10) having a thickness defined to determine a defined inscribed volume ($V_i$), said actuating wall (2) extending over said frame (10) and being deformable so as to reduce the volume of the reservoir and so as to penetrate into the inscribed volume.

10 Claims, 2 Drawing Sheets

FLUID DISPENSER

CROSS REFERENCE TO RELATED APPLICATION

This application claims the benefit under 35 U.S.C. §119 (e) of pending U.S. provisional patent application Serial No. 60/432,668, filed Dec. 12, 2002, and priority under 35 U.S.C. §119(a)–(d) of French patent application No. FR-02.12417, filed Oct. 7, 2002.

TECHNICAL FIELD OF THE INVENTION

The present invention relates to a fluid dispenser for dispensing fluid in liquid or powder form, the fluid dispenser comprising a reservoir provided with at least one deformable actuating wall and with a dispensing orifice. Thus, by pressing the actuating wall, it is possible to reduce the internal volume of the reservoir so as to deliver the fluid through the dispensing orifice. That type of dispenser can be used in the fields of perfumes, cosmetics, or indeed pharmaceuticals for dispensing liquids or powders.

BACKGROUND OF THE INVENTION

In the prior art, numerous dispensers of that type exist that use the deformation capacity of a portion of the reservoir to put the fluid that it contains under pressure so as to deliver it through the dispensing orifice. For example, reference can be made to Document FR 2 791 645 which discloses a dispenser in the form of two flexible sheets that are bonded together all the way around their peripheries so as to define a reservoir. A rigid dispensing part is preferably inserted between the two sheets: that dispensing part advantageously forms the dispensing orifice. In addition, a spring may be disposed between the two sheets so as to perform a resilient return function. In that document, provision is even made to close off the dispensing orifice while the spring is compressed to its maximum extent. Thus, a fluid dispenser is obtained that is particularly flat and that can, for example, be included in a magazine by way of a free sample.

The drawback with that prior art dispenser lies in the fact that the spring is held compressed to its maximum extent for a relatively long period, i.e. from being manufactured to being used. Experience shows that a spring made of a plastics material no longer relaxes after it has been held for a certain length of time in its maximum compressed state. This is because plastics material tends to creep over time. Alternatively, if the spring is made of metal, then the fluid to be dispensed remains in contact with the metal for a long period of time. In some cases, that can be inconvenient, or even harmful, depending on the fluid to be dispensed. There is therefore a real problem with the return spring of that type of dispenser.

BRIEF SUMMARY OF THE INVENTION

An object of the present invention is to remedy the above-mentioned drawback of the prior art by defining a dispenser that is relatively flat and whose spring means are not compressed or at least are compressed only very slightly when pressure is exerted on the dispenser while lying flat. For example, the dispenser must be capable of being included in magazines without any risk of compressing the spring means too strongly.

To achieve this object, the present invention makes provision for the fluid dispenser to further comprise a body defining a frame having a thickness defined to determine a defined inscribed volume, said actuating wall extending over said frame and being deformable so as to reduce the volume of the reservoir and so as to penetrate into the inscribed volume. Thus, even if the dispenser is included between two substantially plane surfaces and pressure is exerted on said surfaces, there is no risk of reducing the working volume of the reservoir to smaller than the inscribed volume defined by the thickness of the frame.

The present invention provides that the dispenser is provided with return spring means for urging the actuating wall into a rest configuration defining the maximum volume of the reservoir. It is then advantageous for the spring means to be formed integrally by the body which already forms the body. For example, the body may be made of a plastics material.

According to an advantageous characteristic of the invention, the spring means extend inside said frame. In the rest position, the spring means may even extend inside said inscribed volume. In a variant, in the rest position, the spring means extend outside said inscribed volume. When the spring means extend inside the inscribed volume, and when in the rest position, the spring means do not stress the actuating wall(s). It is only after the walls are pressed that the spring means return the actuating wall(s) to the rest position. Conversely, when the spring means extend outside the inscribed volume, they stress the actuating walls, even when in the rest position. This results in the actuating wall bulging where the spring means are in contact with the wall.

In a practical embodiment, the spring means may comprise at least one flexible blade which extends across said frame. For example, the frame may have a constant thickness of approximately in the range 2 millimeters to 4 millimeters.

In a practical embodiment, the dispenser may further comprise two actuating walls defined by two flexible sheets fixed in leaktight manner on either side of said frame.

According to another characteristic, the frame is substantially non-deformable. Thus, the return spring function is performed entirely by the spring means, and not by the frame.

In a practical embodiment, the frame is substantially in the form of a ring.

According to a characteristic, the dispensing orifice is formed by the frame, advantageously in its peripheral surface.

BRIEF DESCRIPTION OF THE DRAWINGS

The invention is described more fully below with reference to the accompanying drawings which show an embodiment of the invention by way of non-limiting example.

In the figures.

Figure 2:
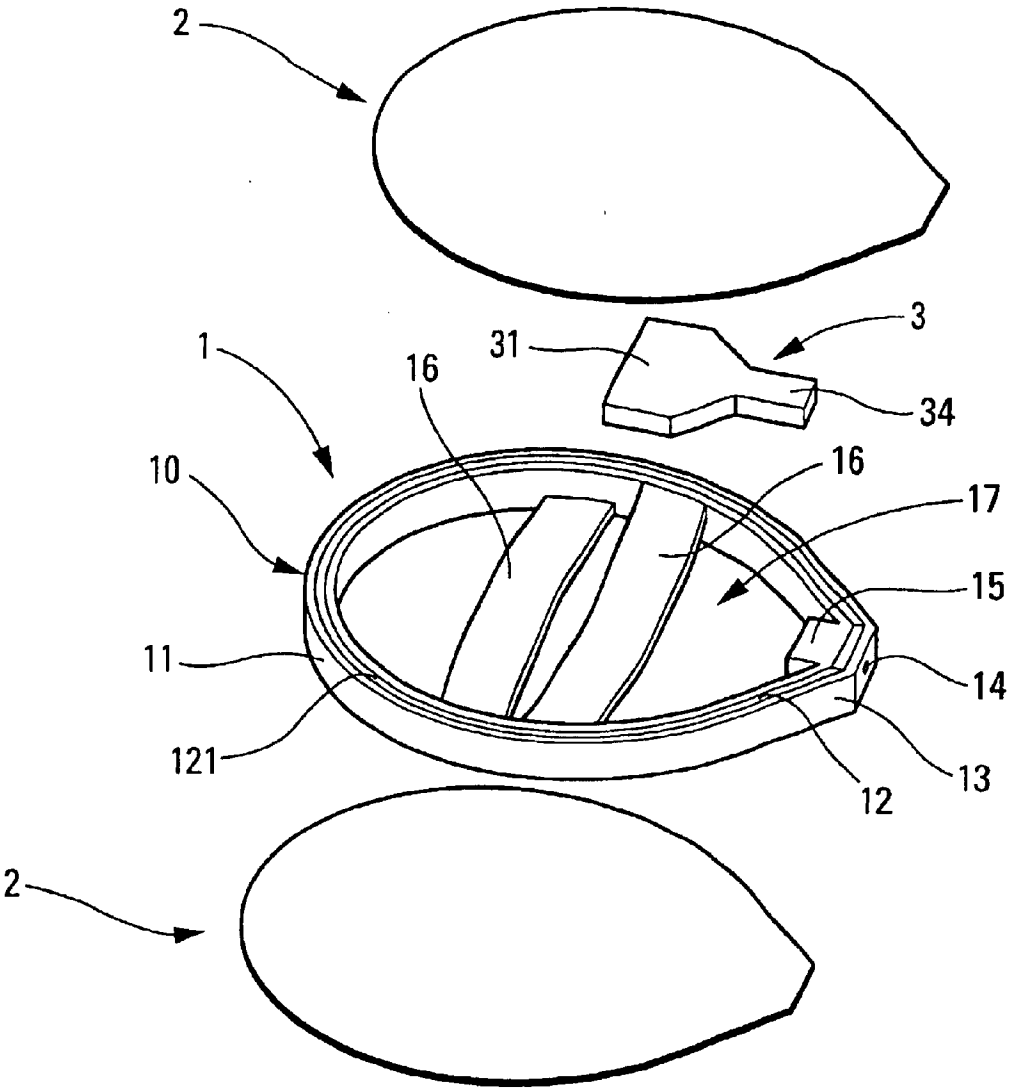
FIG. 2 is an exploded view of the dispenser of FIG. 1.
Figure 1:
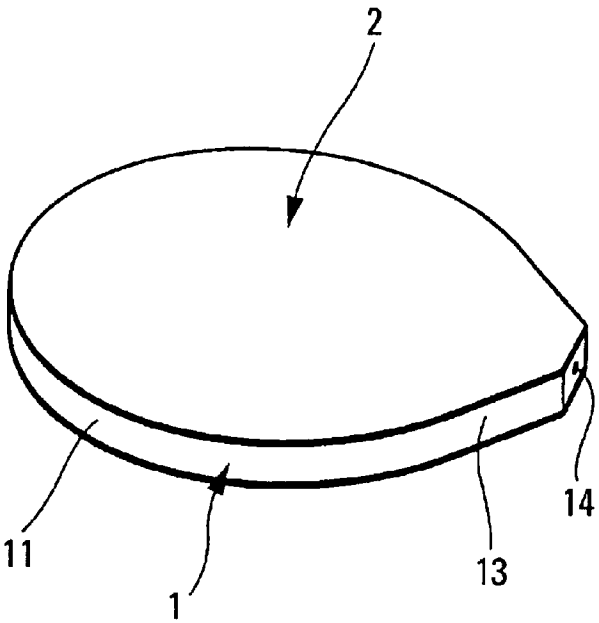
FIG. 1 is a perspective view of a fluid dispenser of the invention.

The fluid dispenser used to illustrate the present invention is made up of three component elements, namely a body 1 and two flexible sheets 2. Optionally, the dispenser may further comprise a piece of porous material 3.

DETAILED DESCRIPTION OF THE INVENTION

The body 1 comprises a frame 10 which is preferably non-deformable, and which forms a closed loop. The frame is substantially circular in this example, but it could also be polygonal, e.g. triangular, square, pentagonal, hexagonal, etc. The frame 10 forms a dispensing head 13 which is integrated into the frame. In the example shown in the figures, the head 13 interrupts the circularity of the frame 10 so as to impart a drop-shaped appearance to it. It can however be considered that the head 13 is an integral part of the frame 10. Thus, the frame 10 defines a peripheral surface 11 which is substantially cylindrical in this example. The frame 10 also forms two edges 12 that are substantially plane but that are annular in shape. For example, each edge 12 may be provided with a bonding bead 121 which forms a projection extending around the entire periphery of the frame 10. It can be seen in FIG. 2. The dispensing head 13 defines a dispensing orifice 14 that establishes communication between the inside of the frame and the outside of the frame. The dispensing orifice opens out at the peripheral surface 11. This can be seen more clearly in FIGS. 3 and 4. In addition, the dispensing head 13 optionally forms an insertion recess 15 designed to receive, optionally, the piece of porous material 3 which may advantageously be configured with an insertion appendage 34 designed to be inserted by force into the recess 15. Thus, the piece of porous material 3 extends freely from the appendage 34 inside the frame 11 by forming a body 31 which is naturally made of porous material. The purpose of the piece of porous material 3 is to become soaked or impregnated with fluid in liquid or powder form so that the dispensing orifice 14 is always fed with fluid. Naturally, it is possible to omit such a piece of porous material 3 for certain uses, and in particular when the fluid is in powder form.

The frame 11 has a defined thickness that corresponds to the height of the peripheral wall 11. In the example used for the present invention, the thickness is constant around the entire periphery of the frame 11. However, it is possible to imagine said thickness varying locally. The body 10 is non-deformable at least in the direction of the thickness of the frame 11. In other words, the thickness of the frame 11 cannot be degraded or modified even when it is subjected to large pressures. Conversely, the frame 11 can be deformed in the direction of its width so that the loop or ring can be deformed slightly. However, the ring is preferably also non-deformable. Thus, the frame 11 defines an inscribed internal volume $V_i$ which is equal to the area defined by the inside the frame 11 multiplied by the thickness of the frame 11. This corresponds to the volume of the frame when it is placed between two entirely plane surfaces. Since the thickness of the frame is non-deformable or non-degradable, said inscribed volume $V_i$ is constant and defined.

Figure 3:
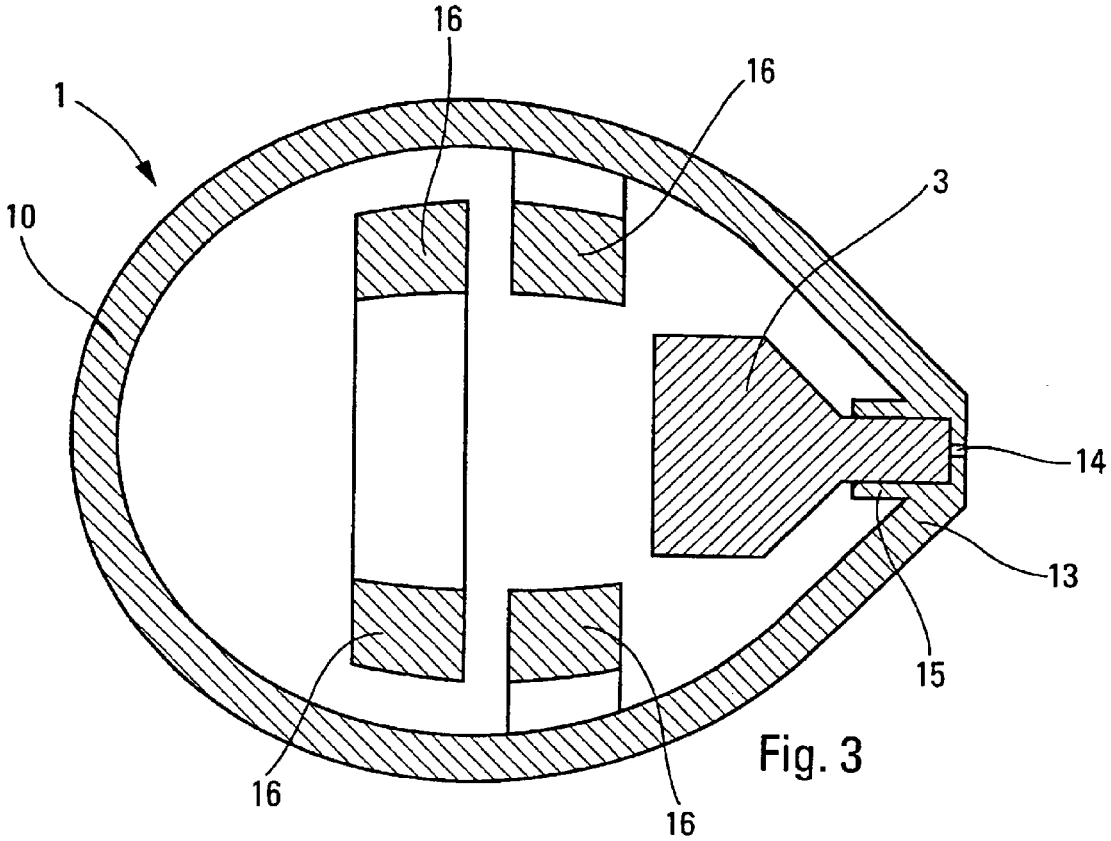
FIG. 3 is a horizontal section view through the dispenser of the FIG. 1.
Figure 4:
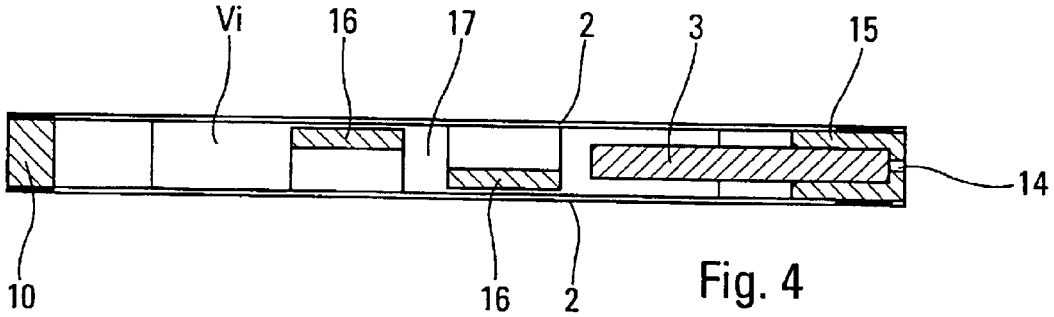
FIG. 4 is a vertical section view through the dispenser of FIG. 1.
Figure 5:
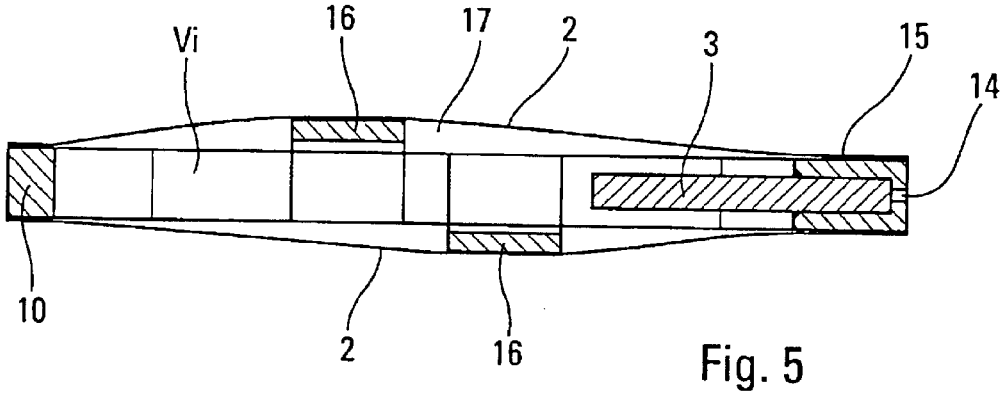
FIG. 5 is a view similar to FIG. 4, showing a variant embodiment of the dispenser of the invention.

The body 10 may also integrally form return spring means which, in this example, are in the form of two flexible blades 16 which extend transversely inside the frame 11. One blade 16 may be concave while the other may be convex, as can be seen in FIG. 2. The two blades 16 may be entirely inscribed within the volume $V_i$, as shown in FIG. 4. In a variant, the blades 16 may extend at least partially outside the volume $V_i$, as shown in FIG. 5.

In the invention, the body 1 is associated with two separate flexible sheets 2 which are mounted and fixed in leaktight manner on either side of the frame 11. The two sheets 2 are preferably heat-sealed around their peripheries to respective ones of the bonding beads 121 formed on the two edges 12 of the frame 11. In practice, one sheet is firstly bonded to the frame 11 so as to form a receptacle. Fluid can then be fed into the receptacle. Then, it is necessary merely to bond the other sheet 2 to close off the receptacle and thus to form a reservoir 17. It is easy to understand from FIGS. 4 and 5 that the inscribed volume $V_i$ is different from the internal volume of the reservoir 17. In FIG. 4, the volume $V_i$ is equal to the internal volume of the reservoir 17 when the dispenser is at rest. Conversely, as soon as the sheets 2 are pressed to bring them together, the blades 16 are deformed and the internal volume of the reservoir 17 is reduced so that it is then smaller than the inscribed volume $V_i$. In FIG. 5, the internal volume of the reservoir 17 is larger than the inscribed volume $V_i$ in the rest position, since the blades 16 project from the volume $V_i$ in the rest position. The volume of the reservoir 17 is equal to the volume $V_i$ only when the dispenser is, for example, disposed between two plane surfaces so as to return the blades 16 to within the volume $V_i$. This is as in the configuration shown in FIG. 4, except that the blades 16 are then partially stressed.

In all cases, regardless of whether or not the blades 16 are inscribed within the volume $V_i$, a dispenser is obtained whose inscribed volume is constant and defined. Thus, by filling the reservoir 17 with a quantity of fluid equal to or smaller than the volume $V_i$, it is guaranteed that the fluid is not subjected to any excessive pressure when it is disposed between two plane surfaces, as applies when the dispenser is included in stacked-up magazines. Furthermore, it is guaranteed that the spring means 16 are not compressed to an excessive extent. Thus, it is guaranteed that the spring means operate properly even when the dispenser is used a long time after it was manufactured. Naturally, when the dispenser is used, the volume of the reservoir 17 decreases below the value of the volume $V_i$, since the sheets 2 are deformable and the blades 16 are flexible. It is possible to reach a configuration in which the blades 16 extend in substantially the same planes as the is sheets 2 pressed against either side. However, as soon as the pressure on the sheets 2 is released, they return substantially to their rest position under the action of the blades 16 which relax.

By means of the invention, a dispenser is obtained that is both extremely flat and also non-deformable, and whose optional spring means do not need to be compressed during storage.

What is claimed is:

1. A fluid dispenser for dispensing fluid in liquid or powder form, the fluid dispenser comprising a reservoir (17) provided with at least one deformable actuating wall (2) and with a dispensing orifice (14), said dispenser comprising a body (1) defining a frame (10) having a thickness defined to determine a defined inscribed volume ($V_i$), said actuating wall (2) extending over said frame (10) and being deformable so as to reduce the volume of the reservoir and so as to penetrate into the inscribed volume, said dispenser comprising return spring means (16) urging the actuating wall (2) into a rest configuration defining the maximum volume of the reservoir, characterized in that the spring means (16) are formed integrally by the body (1).

2. A dispenser according to claim 1, in which the spring means (16) extend inside said frame (10).

3. A dispenser according to claim 1, in which, in the rest position, the spring means (16) extend inside said inscribed volume ($V_i$).

4. A dispenser according to claim 1, in which, in the rest position, the spring means (16) extend outside said inscribed volume ($V_i$).

5. A dispenser according to claim 1, in which the spring means comprise at least one flexible blade (16) which extends across said frame (10).

6. A dispenser according to claim 1, in which the frame (10) has a constant thickness of approximately in the range 2 millimeters to 4 millimeters.

7. A dispenser according to claim 1, further comprising two actuating walls defined by two flexible sheets (2) fixed in leaktight manner on either side of said frame (10).

8. A dispenser according to claim 1, in which the frame (10) is substantially non-deformable.

9. A dispenser according to claim 1, in which the frame (10) is substantially in the form of a ring.

10. A dispenser according to claim 1, in which the dispensing orifice (14) is formed by the frame (10), advantageously in its peripheral surface (11).

* * * * *